US009527281B2

(12) United States Patent
Yabe et al.

(10) Patent No.: US 9,527,281 B2
(45) Date of Patent: Dec. 27, 2016

(54) LIQUID EJECTION HEAD AND LIQUID EJECTION APPARATUS

(71) Applicant: CANON KABUSHIKI KAISHA, Tokyo (JP)

(72) Inventors: Kenji Yabe, Yokohama (JP); Yasuhiko Osaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/480,441

(22) Filed: Sep. 8, 2014

(65) Prior Publication Data

US 2015/0070438 A1 Mar. 12, 2015

(30) Foreign Application Priority Data

Sep. 10, 2013 (JP) ..... 2013-187348

(51) Int. Cl.
*B41J 2/14* (2006.01)

(52) U.S. Cl.
CPC ..... *B41J 2/14072* (2013.01); *B41J 2/14129* (2013.01)

(58) Field of Classification Search
CPC ..... B41J 2002/14491; B41J 2/14072; B41J 2/1433; B41J 2/1623; B41J 2/1629; B41J 2/1631; B41J 2/164
USPC ..... 347/50
See application file for complete search history.

(56) References Cited

U.S. PATENT DOCUMENTS 6,137,443 A * 10/2000 Beatty ..... B41J 2/14032 347/63
6,454,955 B1 * 9/2002 Beerling ..... B41J 2/14024 216/17
6,612,672 B2 * 9/2003 Yasuda ..... 347/12
2002/0033861 A1 * 3/2002 Boyd ..... B41J 2/14024 347/42
2002/0109751 A1 * 8/2002 McElfresh ..... B41J 2/14072 347/40
2003/0210301 A1 * 11/2003 Seabridge ..... B41J 2/14072 347/58
2004/0183866 A1 * 9/2004 Conta ..... B41J 2/15 347/65
2008/0129781 A1 * 6/2008 Furukawa ..... 347/50
2011/0308715 A1 * 12/2011 Fujita ..... B41J 2/161 156/247

(Continued)

FOREIGN PATENT DOCUMENTS

JP 2000-280477 A 10/2000

*Primary Examiner* — Matthew Luu
*Assistant Examiner* — Patrick King
(74) *Attorney, Agent, or Firm* — Canon U.S.A., Inc. IP Division

(57) ABSTRACT

A liquid ejection head includes a first recording element substrate, a second recording element substrate, and an electric wiring substrate. The first and second recording element substrates each includes an energy generating element that generates energy for ejecting a liquid, and an electroconductive protective film that is disposed so as to cover at least the energy generating element. The electric wiring substrate includes wiring for supplying electric power to the first and second recording element substrates. The electroconductive protective film of the first recording element substrate and the electroconductive protective film of the second recording element substrate are electrically connected to each other through the electric wiring substrate.

3 Claims, 9 Drawing Sheets

(56) References Cited

U.S. PATENT DOCUMENTS

2012/0274703 A1* 11/2012 Tsuchii et al. ..... 347/40
2012/0306968 A1* 12/2012 Benjamin ..... 347/40

* cited by examiner

LIQUID EJECTION HEAD AND LIQUID EJECTION APPARATUS

BACKGROUND OF THE INVENTION

Field of the Invention

The present invention relates to a liquid ejection head and a liquid ejection apparatus for ejecting a liquid.

Description of the Related Art

Some liquid ejection heads for ejecting a liquid, such as an ink, include a recording element substrate and an ejection orifice member. The recording element substrate includes a plurality of energy generating elements for generating thermal energy used to eject a liquid. The ejection orifice member has ejection orifices from which the liquid is ejected. Heat generating resistor layers, which generate heat when electrified, are used as the energy generating elements. The heat generating resistor layers generate heat for forming bubbles in the liquid, and the liquid is ejected from the ejection orifices due to pressure generated by the bubbles.

The energy generating elements are covered with an insulation film, and a protective film is formed on the insulating film. The protective film is made of an electroconductive material such as tantalum (Ta). The protective film serves to protect the energy generating elements from a so-called cavitation impact and from a chemical reaction that occurs in the liquid. Here, the term "cavitation impact" refers to an impact that occurs when bubbles, generated by the energy generating elements, burst.

There is a concern that, if the insulation film of the liquid ejection head has a defect, such a hole (pin hole), the energy generating elements and the protective film may be electrically connected to each other, so that the protective film and the liquid may cause an electrochemical reaction, leading to degradation of the protective film. When degradation of the protective film occurs, the thermal efficiency of energy transferred from the energy generating element to the liquid changes. Therefore, for example, it is necessary to check the electrical insulation between the energy generating elements and the protective film during the process of manufacturing the recording element substrate.

Japanese Patent Laid-Open No. 2000-280477 discloses an inkjet recording head including a protective film and a circuit for detecting whether or not en electric current flows through a protective film and a liquid (ink) in a flow path.

Such detection can be easily performed by connecting protective films in the same recording element substrate so as to be electrically connected to each other and by using a terminal provided in the substrate. On the other hand, when the protective films are electrically connected to each other in the recording element substrate, degradation of some of the protective films may affect all the protective films in the substrate.

Some liquid ejection heads, such as a full-line head having a length corresponding to the width of a recording medium, includes a plurality of recording element substrates. If the substrates described above, in each of which the protective films are electrically connected to each other, are used for a liquid ejection head of this type, the following problem may occur.

If the liquid ejection head is assembled by using a plurality of substrates including a substrate in which a protective film has a defect, the thermal efficiency of the protective film having a defect deviates from those of other substrates, and therefore the minimum energy required for ejecting a liquid varies. When the liquid ejection characteristics of some of the substrates vary as described above in a liquid ejection head having a plurality of substrates, such as a full-line head, the amount of ejected ink varies and therefore the density of recording becomes nonuniform.

The same problem may occur if a hole is formed in the protective films or the insulation films of some of the substrates during use of the liquid ejection head.

SUMMARY OF THE INVENTION

The present invention provides a liquid ejection head that includes a plurality of recording element substrates and that is capable of suppressing occurrence of nonuniform recording due to degradation of protective films in some of the substrates.

A liquid ejection head includes a first recording element substrate, a second recording element substrate, and an electric wiring substrate. The first and second recording element substrates each includes an energy generating element that generates energy for ejecting a liquid, and an electroconductive protective film that is disposed so as to cover at least the energy generating element. The electric wiring substrate includes wiring for supplying electric power to the first and second recording element substrates. The electroconductive protective film of the first recording element substrate and the electroconductive protective film of the second recording element substrate are electrically connected to each other through the electric wiring substrate.

Further features of the present invention will become apparent from the following description of exemplary embodiments with reference to the attached drawings.

DESCRIPTION OF THE EMBODIMENTS

Liquid Ejection Head

Figure 2A:
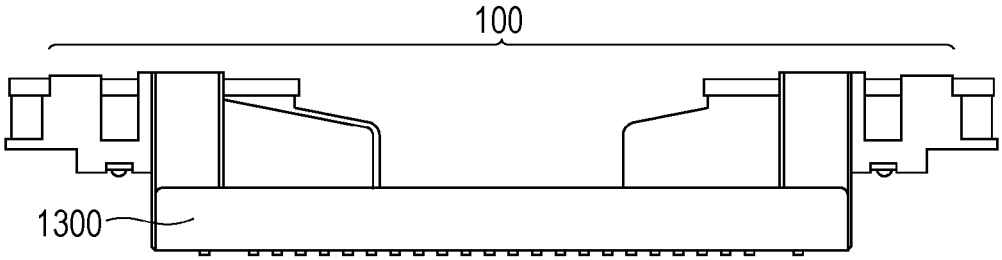
FIGS. 2A and 2B illustrate an inkjet recording head.
Figure 2B:
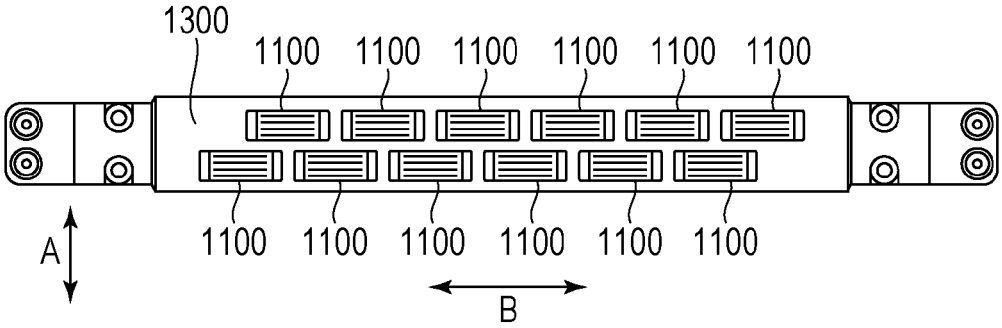

FIGS. 2A and 2B illustrate the structure of an inkjet recording head 100 (hereinafter, referred to as a "recording head"), which corresponds to a liquid ejection head according to the present invention. FIG. 2A is a side view of the recording head 100. FIG. 2B is a bottom view of the recording head 100, showing a surface from which an ink is ejected.

The recording head 100 according to the present embodiment is a full-line inkjet recording head, which can perform recording on a wide recording medium without scanning the recording medium. The recording head 100 includes a plurality of recording element substrates 1100 so as to cover the maximum width of a recording medium to be used.

Recording Element Substrate

Figure 3A:
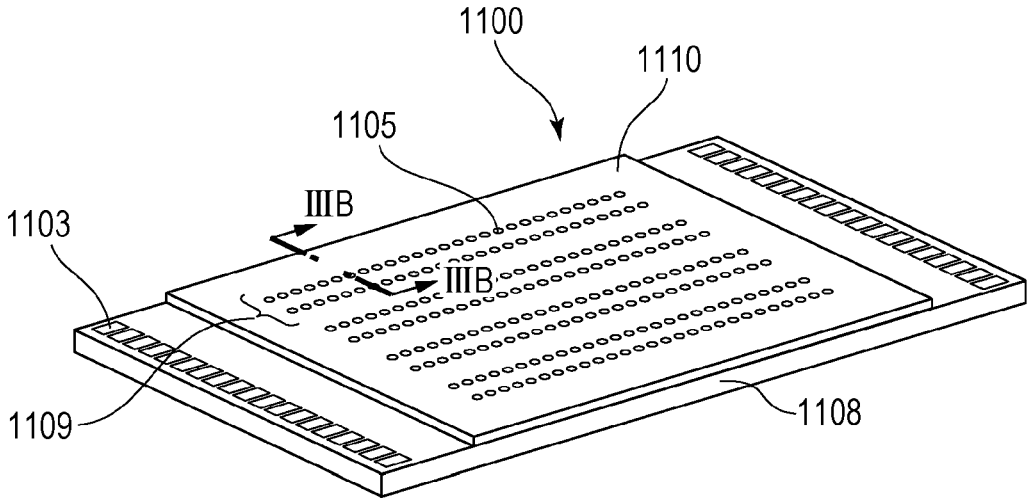
FIGS. 3A and 3B illustrate one of the recording element substrates.
Figure 3B:
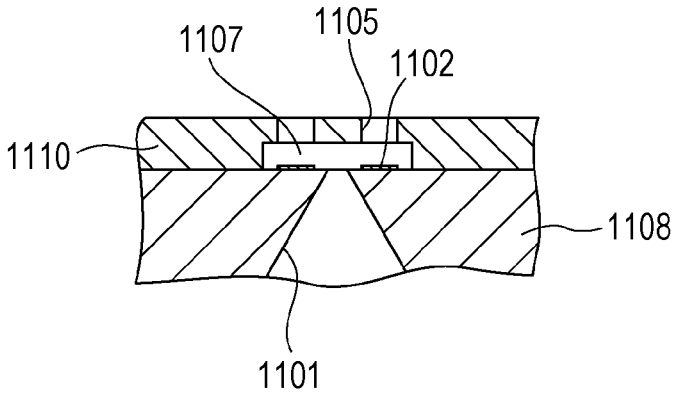

Referring to FIGS. 3A and 3B, the structure of one of the recording element substrates 1100 will be described. FIG. 3A is perspective view of the recording element substrate 1100. FIG. 3B is a sectional view taken along a line IIIB-IIIB of FIG. 3A.

The recording element substrate 1100 includes a substrate 1108 in which ink supply holes 1101 are formed. The substrate 1108 has a thickness of, for example, 0.5 to 1 mm. Each of the ink supply holes 1101 is a long-groove-shaped through-hole. On both sides of the ink supply hole 1101, heat application portions 1102 are arranged along a pair of rows in a staggered manner. Electrode terminals 1103 for supplying electric power are disposed at ends of the recording element substrate 1100. An ejection orifice member 1110 is disposed on the substrate 1108. In the ejection orifice member 1110, ejection orifices 1105, bubble-generating chambers 1107, and ink flow paths are formed so as to correspond to the heat application portions 1102 by photolithography. The ejection orifices 1105 are disposed so as to face the heat application portions 1102. An ink is supplied from the ink supply hole 1101, the heat application portions 1102 apply thermal energy to the ink to generate bubbles, and therefore the ink is ejected.

As illustrated in FIG. 3A, the recording element substrate 1100 has a plurality of ejection orifice rows 1109. In the present embodiment, four ink supply holes 1101 are formed so as to correspond to four sets of ejection orifice rows 1109. Ink having the same color may be supplied through the plurality of ink supply holes 1101 of the recording element substrate 1100. Alternatively, inks of four colors, such as cyan, magenta, yellow, and black may be supplied through the four ink supply holes 1101.

Figure 4:
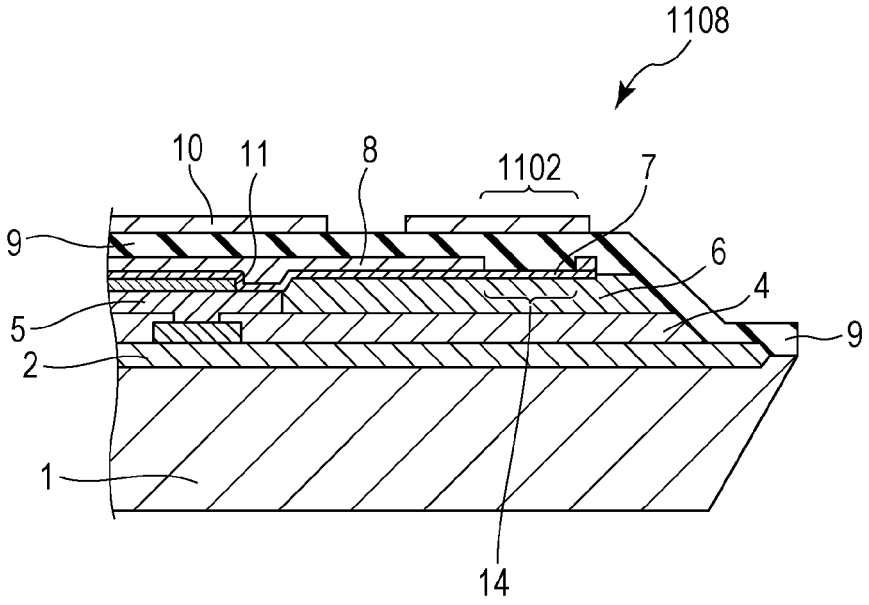
FIG. 4 is a schematic cross-sectional view illustrating the layered structure of the recording element substrate.

Referring to FIG. 4, the layer structure of the recording element substrate 1100 will be described. The ejection orifice member 1110 is not illustrated in FIG. 4.

A Si substrate or a Si substrate having an embedded drive IC is used as a substrate 1. A heat accumulating layer 2, which is formed by thermal oxidation or the like, is disposed on the substrate 1. A heat accumulating layer 4, which is formed by CVD or the like, is disposed on the heat accumulating layer 2. Common bus wiring 5 is formed on the heat accumulating layer 4 by forming a wiring layer by sputtering, forming a pattern by photolithography, and etching the wiring layer by reactive ion etching. The common bus wiring 5 is made of Al, Cu, Al—Si, Al—Cu, or the like. An insulation film 6, which is made from SiO2 or the like by sputtering and plasma CVD, is disposed on the common bus wiring 5. A through-hole portion 11 is formed in the insulation film 6 by forming a through-hole pattern by photolithography or the like and etching the insulation film 6 by dry etching or the like.

A heat generating resistor layer 7, which is made of TaN, TaSiN, or the like, and individual electrode wiring 8, which is made of Al, Cu, Al—Cu, Al—Si or the like, are formed on the insulation film 6 by reactive sputtering. A pattern is formed by photolithography on the heat generating resistor layer 7 and the individual electrode wiring 8, and the layer 7 and the wiring 8 are continuously etched by reactive ion etching or the like. Moreover, a part of the individual electrode wiring 8 is removed by photolithography and wet etching. This part of the heat generating resistor layer 7, which is exposed from the individual electrode wiring 8, serves as an electrothermal transducer 14, which corresponds to an energy generating element. The heat generating resistor layer 7 and the individual electrode wiring 8 may be stacked in the opposite order.

An insulation film 9, which is made of SiN, is formed on the individual electrode wiring 8 by plasma CVD. An anti-cavitation film 10 (hereinafter, referred to as a "protective film"), which corresponds to an electroconductive protective film, is formed on the insulation film 9 by sputtering. The protective film 10 is disposed at least in an upper part of the substrate 1108 corresponding to the electrothermal transducer 14. A part of the protective film 10 that is positioned in the upper part corresponding to the electrothermal transducer 14 and that contacts ink functions as the heat application portion 1102. In the present embodiment, a tantalum (Ta) film is used as the protective film 10. The materials of the recording element substrate 1100 described above are examples, and the materials are not limited to the aforementioned substances. For example, iridium (Ir) can be used instead of tantalum, or both of tantalum and iridium may be used.

Electric Wiring Substrate

Figure 5:
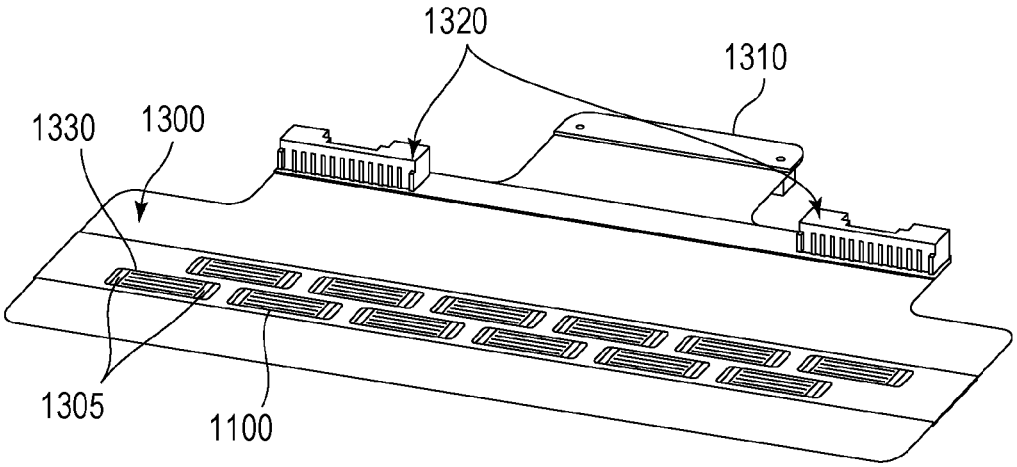
FIG. 5 is a schematic view illustrating an electric wiring substrate.

FIG. 5 illustrates the structure of an electric wiring substrate 1300. The recording element substrates 1100 are also shown in FIG. 5.

The electric wiring substrate 1300, in which a plurality of wires are formed, electrically connects the recording element substrates 1100 to the body of an inkjet recording apparatus 3000 through the wires. Electrical signals, electric power, and the like, which are supplied from the outside and used to eject ink, are supplied to the recording element substrates 1100 through the electric wiring substrate 1300. In the present embodiment, the electric wiring substrate 1300 is a flexible wiring substrate in which wiring is formed on a resin film.

The electric wiring substrate 1300 has a plurality of openings 1330, in which the recording element substrates 1100 are placed. The electric wiring substrate 1300 includes electrode terminals (not shown), an electric signal connector 1310, and a power connector 1320. The electrode terminals are provided so as to correspond to the electrode terminals 1103 of the recording element substrate 1100. The electric signal connector 1310 is disposed at an end of wiring and receives electric signals from the body of the inkjet recording apparatus 3000. The power connectors 1320 receive electric power.

The electric wiring substrate 1300 and the recording element substrates 1100 are electrically connected to each other by, for example, connecting the electrode terminals 1103 of the recording element substrates 1100 to the electrode terminals of the electric wiring substrate 1300 by wire bonding using a gold wire. The electrode terminals 1103 of the recording element substrate 1100, the electrode terminals of the electric wiring substrate 1300, and the bonding wires are covered by sealants 1305, so that these terminals and wires are protected from corrosion due to ink and from an external shock.

Inkjet Recording Apparatus

Figure 6:
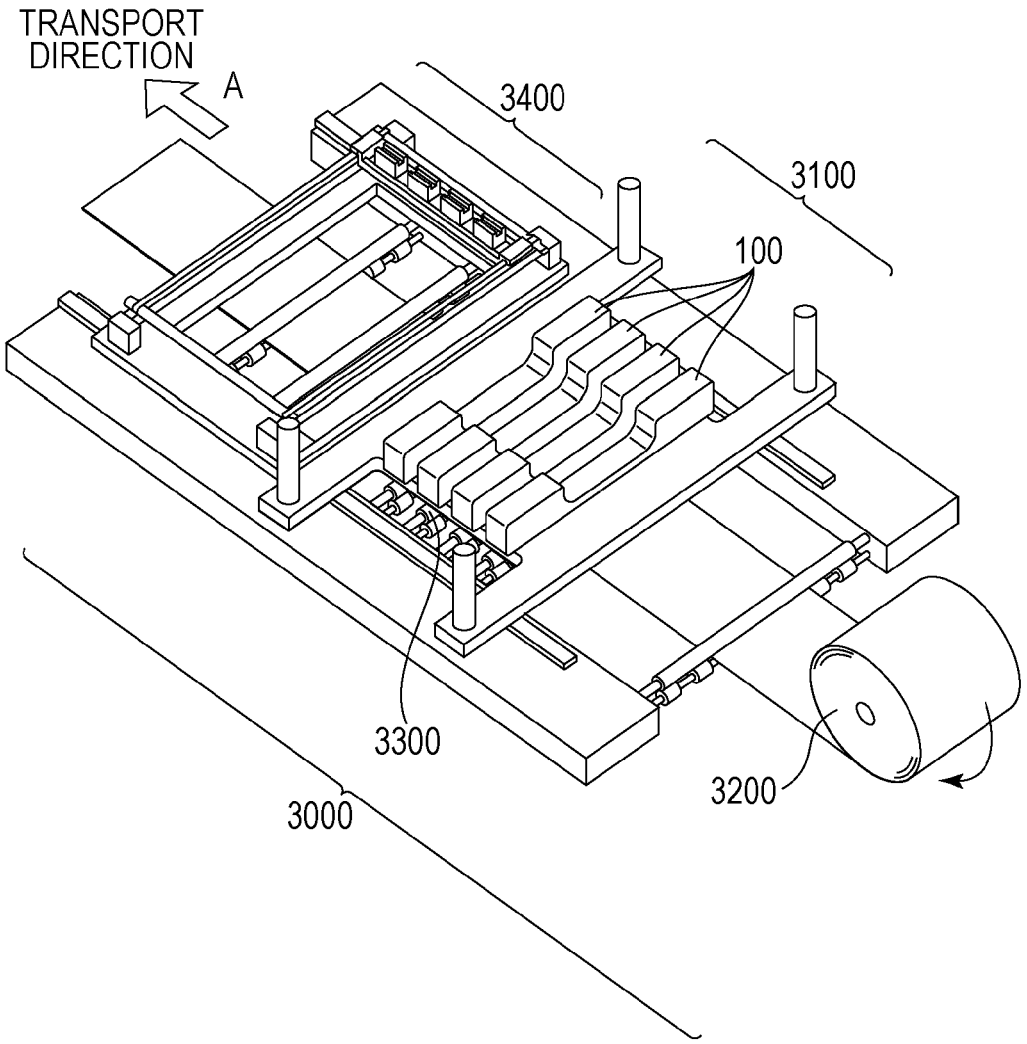
FIG. 6 is a schematic view illustrating an inkjet recording apparatus.

Referring to FIG. 6, the structure of the inkjet recording apparatus 3000, in which the inkjet the recording heads 100 are mounted, will be described.

The recording apparatus 3000 is a line printer that performs printing on a recording sheet, which corresponds to a recording medium, by using the recording heads 100, each of which is a long full-line head, while continuously transporting the recording sheet in a transport direction (direction A). The recording apparatus 3000 includes a holder, a transport mechanism 3300, and a recording unit 3100. The holder holds a recording sheet 3200, which is, for example, a rolled continuous paper sheet. The transport mechanism 3300 transports the recording sheet 3200 at a predetermined speed in the direction A. The recording unit 3100 performs recording on the recording sheet 3200 by using the recording heads 100. The recording sheet 3200 is not limited to a continuous rolled sheet, and may be a cut sheet.

The recording unit 3100 includes the plurality of recording heads 100, which correspond to different ink colors. In the present embodiment, four recording heads 100 are provided so as to correspond to cyan, magenta, yellow, and black. However, there is no limitation on the number of ink colors.

Problem Related to Defect of Recording Element Substrate

Referring to FIGS. 7A to 8C, which are partial sectional views of the recording element substrate 1100, a problem that arises when a defect occurs in the insulation film 9 or the protective film 10 of the recording element substrate 1100 will be described.

Figure 7A:
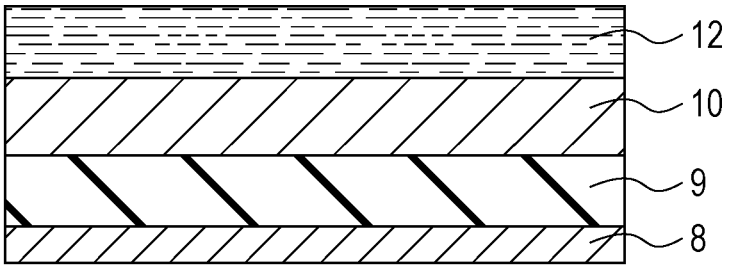
FIGS. 7A to 7C are schematic sectional views for illustrating a problem to be solved by the present invention.
Figure 7B:
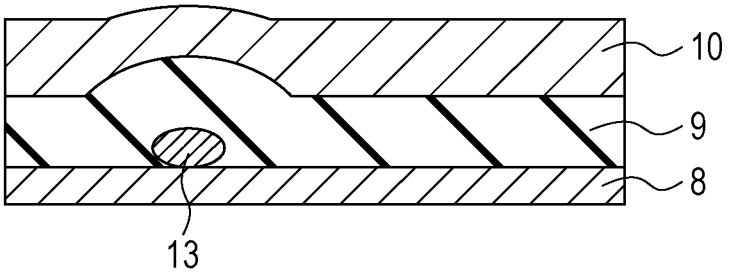
Figure 7C:
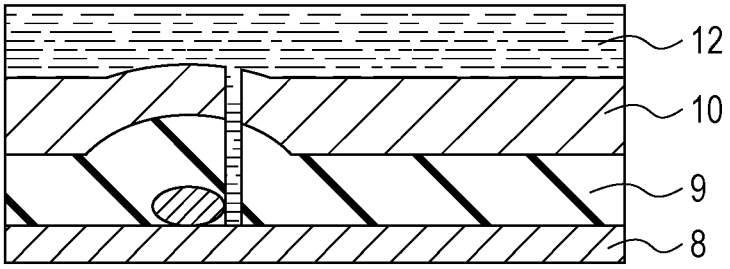
Figure 8A:
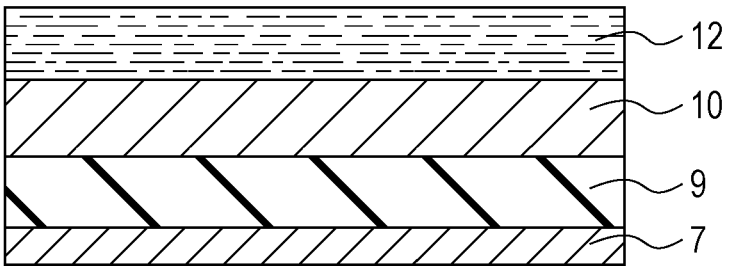
FIGS. 8A to 8C are schematic sectional views for illustrating another problem to be solved by the present invention.

FIGS. 7A and 8A illustrate a recording element substrate 1100 that does not have a defect. The numeral 12 denotes ink. As illustrated in FIG. 7B, when the films of the recording element substrate 1100 are being formed, a foreign matter 13 may adhere to one of the films. If the foreign matter 13 adheres to the individual electrode wiring 8, a bump is generated due to the foreign matter 13, and therefore the thicknesses of parts of the insulation film 9 and the protective film 10 formed on the foreign matter 13 may become smaller than appropriate thicknesses. If this occurs, when the recording head 100 is filled with ink and the electrothermal transducer 14 is driven, a thermal stress is applied to the thin parts of the films and a crack may be generated in the thin parts. As a result, as shown in FIG. 7C, the ink 12 passes through the protective film 10 to the individual electrode wiring 8, and therefore a short circuit may occur between the protective film 10 and the individual electrode wiring 8. Then, the surface of the protective film 10, including Ta, electrically serves as an anode, and an electrochemical reaction between the protective film 10 and the ink occurs. As a result, the surface or the inside of the protective film 10 may become oxidized (also referred to as "anodized") in a short time.

Figure 8B:
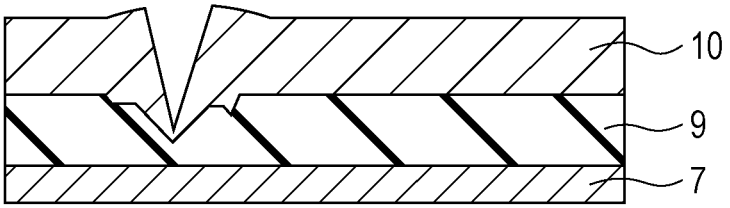
Figure 8C:
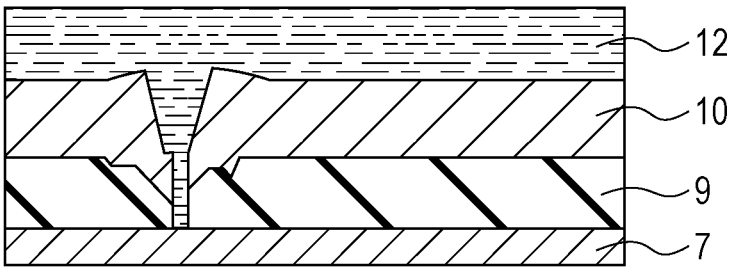

As illustrated in FIG. 8B, a defect in the protective film 10 may occur when the recording head 100 is being manufactured or during use of the recording head 100. If a defect occurs in the protective film 10, for protecting the heat generating resistor layer 7, and the defect extends to the insulation film 9, the ink 12 reaches the heat generating resistor layer 7 and causes a short circuit between the protective film 10 and the heat generating resistor layer 7. Then, in the same manner as described above, the surface of the protective film 10, including Ta, electrically serves as an anode, and an electrochemical reaction between the protective film 10 and the ink occurs, so that the surface or the inside of the protective film 10 may become oxidized in a short time.

If anodization of the protective film 10 occurs as described above, the crystalline state of the protective film 10 is changed and the thermal characteristics of the protective film 10 are changed. Because the protective film 10 is disposed on the electrothermal transducer 14, the minimum energy required for ejecting ink may be changed due to the change in the thermal characteristics of the protective film 10.

When ink is in contact with the surface of the protective film 10, anodization of the protective film 10 propagates to parts of the protective film 10 that are electrically connected to each other. For example, if an electrothermal transducer 14 of a recording element substrate 1100 has a defect, anodization occurs in a part of the protective film 10 located on the electrothermal transducer 14. Then, anodization propagates to a part of another protective film 10 that is electrically connected to the anodized protective film 10, the part being in contact with the ink. If the all of the protective films 10 in the recording element substrate 1100 are electrically connected to each other, anodization occurs almost uniformly in the recording element substrate 1100.

As described above, when the protective film 10 becomes anodized, the minimum energy required for ejection changes, and therefore the amount of ink in an ejected ink droplet and the ejection speed may be affected by the change. In particular, the recording head 100 according to the present embodiment includes a plurality of recording element substrates 1100. In this case, recording performed by a part of the recording head 100 corresponding to the anodized recording element substrate 1100 becomes non-uniform.

In the example described above, a Ta film is used as the protective film 10. However, a protective film 10 that can be used in the present embodiment is not limited to a Ta film, as long as oxidation occurs in the film when a voltage is applied to the film.

First Embodiment

Figure 1A:
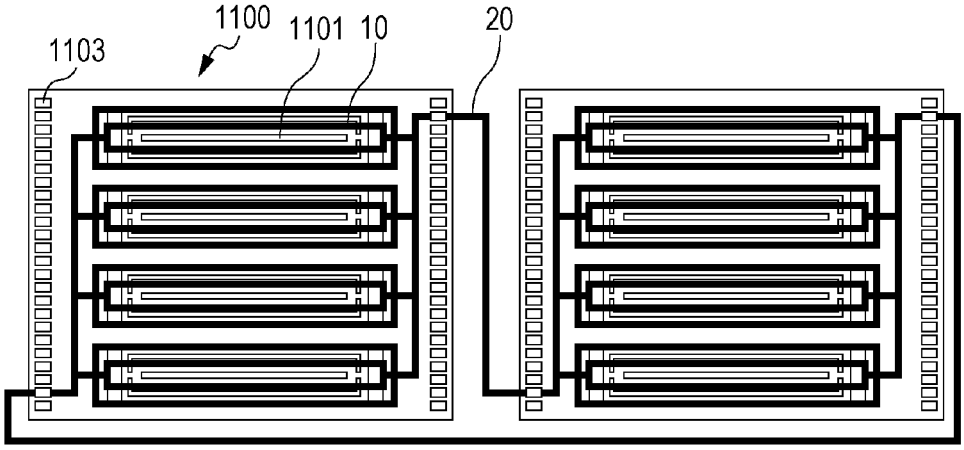
FIGS. 1A and 1B are schematic views illustrating electrical connection between a plurality of recording element substrates according to a first embodiment.
Figure 1B:
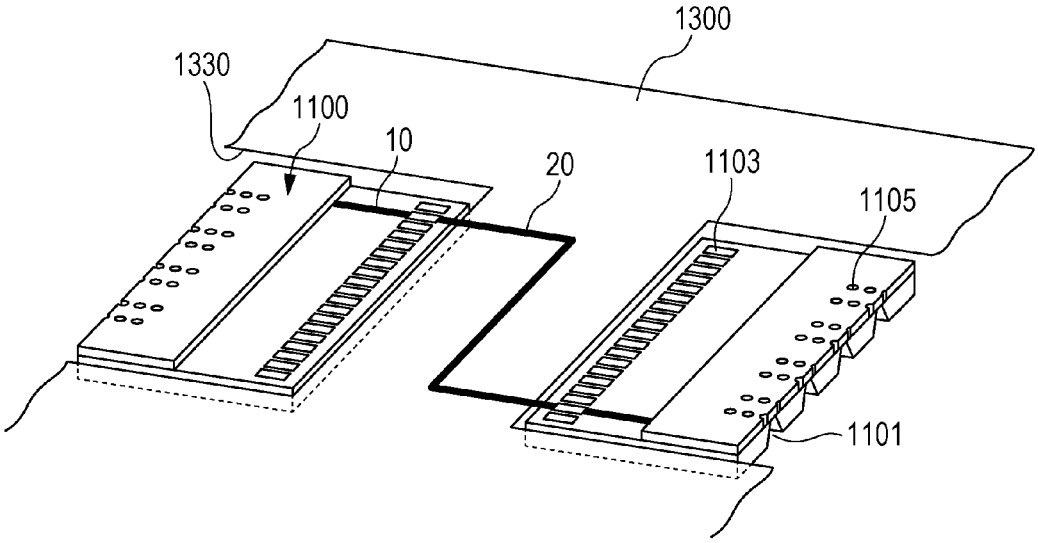

Referring to FIGS. 1A and 1B, a liquid ejection head according to a first embodiment of the present invention will be described. FIG. 1A is a partial bottom view of a recording head 100, and FIG. 1B is a partial perspective view of the recording head 100. In FIG. 1A, an electric wiring substrate 1300, an ejection orifice member 1110, and the like are not illustrated, in order to show the positions of wiring 20 and protective films 10.

A plurality of supply holes 1101 are formed in each of recording element substrates 1100, and the protective films 10 are formed so as to correspond to the supply holes 1101. In FIGS. 1A and 1B, four supply holes and four sets of protective films are formed in each of the recording element substrates 1100, and the four sets of protective films in each of the recording element substrates are electrically connected to each other.

In the first embodiment, the protective films 10 formed in the plurality of recording element substrates 1100 are electrically connected to each other. Thus, when anodization of the protective film 10 due to a defect occurs in some of the plurality of recording element substrates 1100 as described above, it is possible to immediately cause anodization of the protective films 10 of other recording element substrates 1100. Because the protective films 10 become anodized, the thermal characteristics of the protective film 10 are changed. However, the effect of anodization on ejection of ink is small. Moreover, because other recording element substrates 1100 become also anodized, as the entirety of the recording head 100, the thermal characteristics of the protective films 10 of the recording element substrates 1100 can be made uniform. Accordingly, occurrence of nonuniformity in the thermal characteristics the protective films 10 of the plurality of recording element substrates 1100 can be suppressed, and therefore the probability of occurrence of nonuniformity in recording can be reduced.

In each of the recording element substrates 1100, the protective films 10 are disposed in upper parts thereof corresponding to at least electrothermal transducers 14. As illustrated in FIG. 1A, in the recording element substrate 1100, the protective films 10 are electrically connected to each other. The protective films 10 in the recording element substrate 1100 may be connected to each other through conductive layers other than the protective films 10.

In order to electrically connect the protective films 10 of adjacent recording element substrates 1100 to each other, the protective films 10 are connected to electrode terminals 1103 in each of the recording element substrates 1100. The electrode terminals 1103 are electrically connected to the electric wiring substrate 1300 by wire bonding or the like. The electrode terminals 1103 of adjacent recording element substrates 1100 are electrically connected to each other through the wiring 20 in the electric wiring substrate 1300. Thus, the protective films 10 of the plurality of recording element substrates 1100 are electrically connected to each other.

It is not necessary that the wiring 20 in the electric wiring substrate 1300 connect adjacent recording element substrates 1100 to each other. However, the protective films 10 of all of the electric wiring substrates 1300 of the recording head 100 may be electrically connected to each other.

The recording head 100, which includes the recording element substrates 1100 having the structure described above, was filled with ink, and recording corresponding to a million dots per one ejection orifice 1105 was performed by using the inkjet recording apparatus 3000. As are result, it was confirmed that the protective films 10 of all of the recording element substrates 1100 of the recording head 100 were anodized. With the recording head 100 of the first embodiment, nonuniformity in recording was not found.

As described above, according to the first embodiment, reduction in the recording quality of the recording head 100 can be suppressed and the reliability of the product can be increased. Moreover, the yield in manufacturing the recording head 100 can be increased, because a recording element substrate 1100 including a protective film 10 that is likely to be anodized can be used.

The protective film 10 may be anodized, when manufacturing a recording head 100, by applying a voltage to the heat generating resistor layer 7 in a state in which the recording head 100 is filled with ink. By doing so, if the recording head 100 includes a recording element substrate 1100 in which anodization is likely to occur during the manufacturing process, anodization occurs in the protective films 10 of the plurality of recording element substrates 1100 included in the recording head 100. On the other hand, in a recording head 100 that does not include a recording element substrate 1100 in which anodization is likely to occur, anodization does not occur. Subsequently, driving conditions to be input are measured, and data of optimal driving ejection energy is stored in an EEPROM or the like. By driving the recording head 100, which is mounted in a recording apparatus, with the optimal driving ejection energy, uniform printing quality can be maintained irrespective of the presence or absence of anodization.

Second Embodiment

Figure 9A:
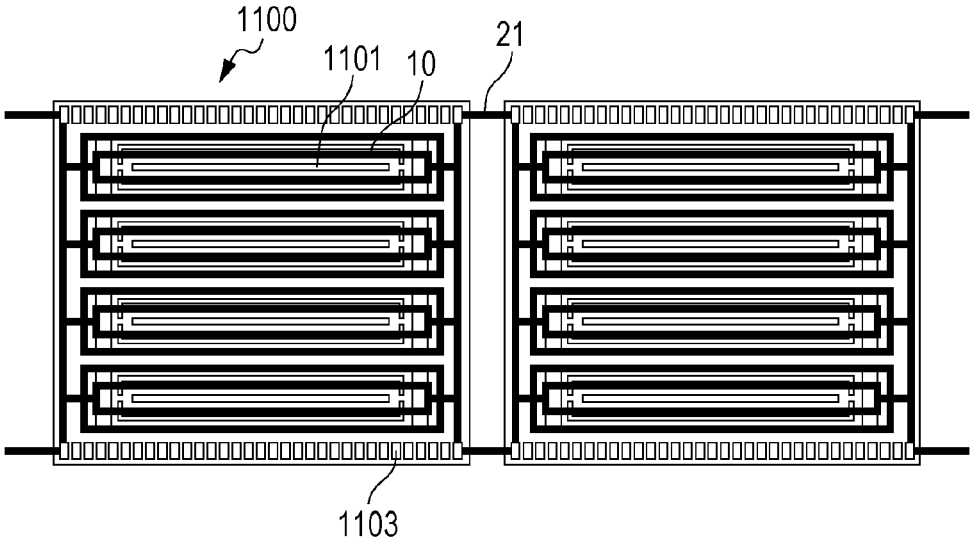
FIGS. 9A and 9B are schematic views illustrating electrical connection between a plurality of recording element substrates according to a second embodiment.
Figure 9B:
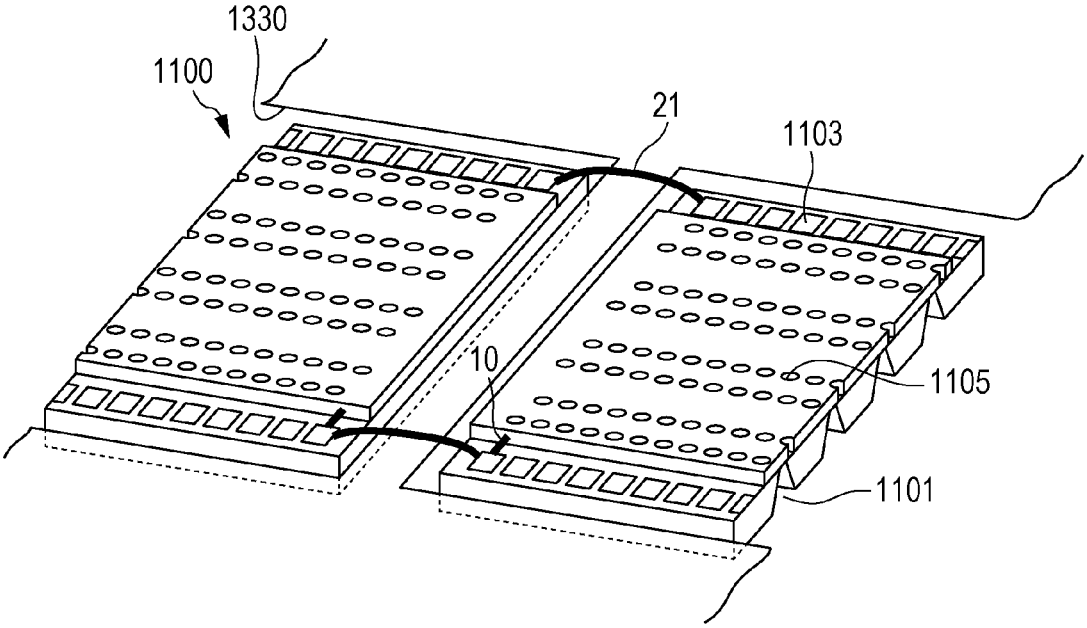

Referring to FIGS. 9A and 9B, a liquid ejection head according to a second embodiment of the present invention will be described. FIG. 9A is a partial bottom view of a recording head 100, and FIG. 9B is a partial perspective view of the recording head 100.

In the second embodiment, as in the first embodiment described above, protective films 10 of a plurality of recording element substrates 1100 are electrically connected to each other.

In each of the recording element substrates 1100, the protective films 10 are disposed in upper parts thereof corresponding to at least the electrothermal transducers 14. The second embodiment differs from the first embodiment in the pattern in which the protective films 10 are arranged. However, as in the first embodiment, in each recording element substrate 1100, the protective films 10 are electrically connected to each other.

In the second embodiment, in order to electrically connect the protective films 10 of adjacent recording element substrates 1100 to each other, electrode terminals 1103 of the recording element substrates 1100 are directly connected to each other through wires 21 by wire bonding or the like.

The second embodiment is particularly effective in a case where the electric wiring substrate 1300 does not have enough space for disposing wiring 20 or in a case where it is necessary to densely arrange a plurality of recording element substrates.

Third Embodiment

Figure 10A:
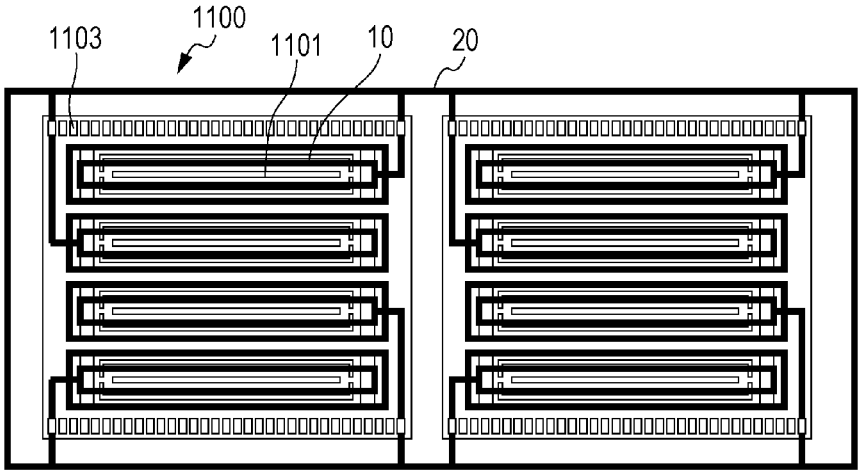
FIGS. 10A and 10B are schematic views illustrating electrical connection between a plurality of recording element substrates according to a third embodiment.
Figure 10B:
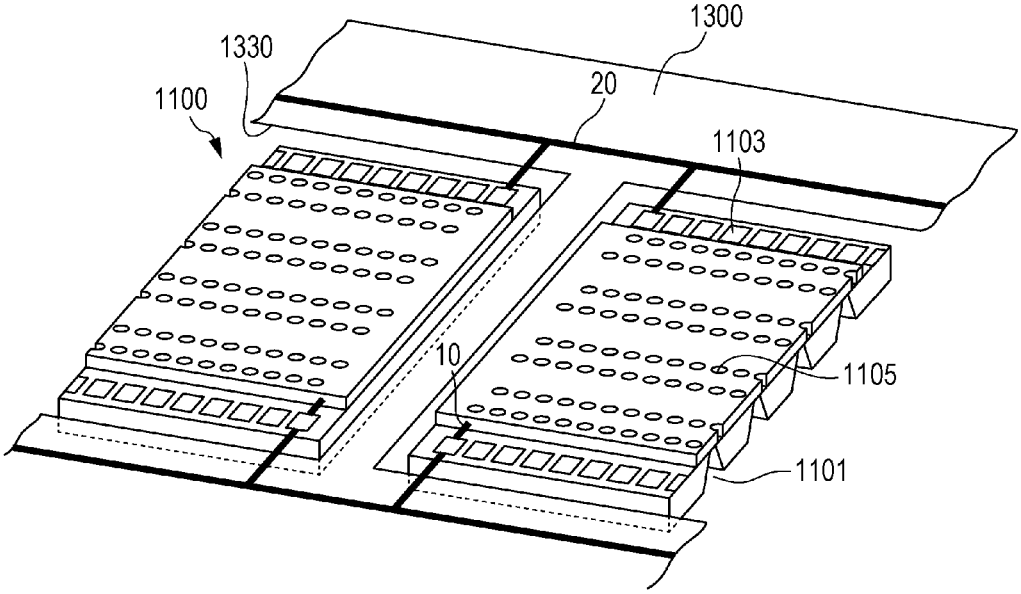

Referring to FIG. 10, a liquid ejection head according to a third embodiment of the present invention will be described. FIG. 10A is a partial bottom view of a recording head 100, and FIG. 10B is a partial perspective view of the recording head 100.

In the third embodiment, as in the first and second embodiments, protective films 10 of a plurality of recording element substrates 1100 are electrically connected to each other.

In each of the recording element substrates 1100, the protective films 10 are disposed in upper parts thereof corresponding to at least electrothermal transducers 14. In the third embodiment, as illustrated in FIG. 10A, the protective films 10 that are disposed around one ink supply hole 1101 are not electrically connected to each other in the recording element substrate 1100.

In the third embodiment, each of the protective films 10, which are not electrically connected to each other in the recording element substrate 1100, are connected to a corresponding one of electrode terminals 1103. The electrode terminals 1103 and an electric wiring substrate 1300 are electrically connected to each other by wire bonding or the like. The electrode terminals 1103 of adjacent recording element substrates 1100 are electrically connected to each other through wiring 20 in the electric wiring substrate 1300. Thus, the protective films 10 disposed in the plurality of recording element substrates 1100 are electrically connected to each other.

In the third embodiment, the wiring 20 and wires are disposed in a part of the recording element substrate 1100 located outside of outer peripheral parts of the substrate 1100 in which the electrode terminals 1103 are disposed, and the wiring 20 and the wires 21 are not disposed between adjacent recording element substrates 1100. In other words, the electrode terminal 1103 are connected to each other through the wiring 20, which is disposed outside of the recording element substrates 1100 in a direction crossing the direction in which the recording element substrates 1100 are arranged. The third embodiment is effective in a case where it is necessary to dispose adjacent recording element substrates 1100 more densely in the direction in which the recording element substrates 1100 are arranged.

A unit for detecting a condition of the protective film 10, that is, the presence/absence of anodization in the protective films 10, may be mounted in the recording head 100 or the recording apparatus 3000. Examples of the detection method include a method of periodically measuring the minimum energy required for ejection, a method of detecting a leakage current that flows when a voltage is applied to the electrothermal transducer 14, and a method of detecting the difference in the amount of light reflected by the protective film 10. On the basis of the detection result obtained by the unit for detecting anodization, a control unit, which is configured to control drive ejection energy to be generated by the electrothermal transducers 14, controls the drive ejection energy generated by the electrothermal transducers corresponding to the protective film 10 in which anodization has occurred. Thus, a change in the hue before and after starting anodization can be suppressed.

The recording head 100 in the embodiments described above is a full-line recording head. However, this is not a limitation, and the present invention can be applied to a recording head 100 of any type that includes a plurality of recording element substrates 1100.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-187348, filed Sep. 10, 2013, which is hereby incorporated by reference herein in its entirety.

What is claimed is:

1. A liquid ejection head comprising:

a first recording element substrate and a second recording element substrate, each including:

a substrate portion having a plurality of longitudinally-shaped supply holes formed through the substrate and positioned parallel with respect to other;

an ejection orifice member disposed on top of the substrate, including:

a plurality of bubble chambers formed in the ejection orifice member that are respectively disposed in a longitudinal row, wherein a heat application portion that applies thermal energy to generate bubbles for ejecting liquid from the ejection orifice is disposed inside of each of the bubble chambers; and a plurality of ejection orifice rows respectively disposed in a longitudinal row above the plurality of bubble chambers; and a plurality of sets of electroconductive protective films disposed in an upper part of the substrate portion so as to respectively cover at least the plurality of heat application portions, the plurality of sets of electroconductive protective films being electrically connected to each other in parallel; and a plurality of electrode terminals disposed on each opposing end of the substrate portion; and an electric wiring substrate including wiring for supplying electric power to the first recording element substrate and the second recording element substrate, wherein the plurality of sets of electroconductive protective films from the first recording element substrate and the second recording element substrate are further electrically connected to each other in parallel through the electric wiring substrate via at least one electrode terminal of each opposing end of each of the first recording element substrate and the second recording element substrate, and wherein when anodization of a portion of the electroconductive protective film in the liquid ejection head occurs due to a defect, anodization is then also caused to occur with all remaining other portions of the electroconductive protective film, thereby causing thermal characteristics of the plurality of sets of electroconductive protective films to be made uniform.

2. The liquid ejection head according to claim 1, wherein the electroconductive protective film includes tantalum.

3. A liquid ejection head comprising:

a first and a second recording element, each including:

a substrate having a plurality of supply holes formed through the substrate;

an ejection orifice member disposed on top of the substrate, including:

a plurality of bubble chambers formed in the ejection orifice member that are respectively disposed above the plurality of supply holes; and a plurality of ejection orifices disposed above the plurality of bubble chambers; and a plurality of sets of electroconductive protective films disposed in an upper part of the substrate so as to respectively cover at least a plurality of heat application portions, the plurality of sets of electroconductive protective films being electrically connected to each other in parallel; and a plurality of electrode terminals disposed on each opposing end of the substrate; and an electric wiring substrate including wiring for supplying electric power to the first and second recording elements, wherein the plurality of sets of electroconductive protective films from the first and second recording elements are further electrically connected to each other in parallel through the electric wiring substrate via at least one electrode terminal of each opposing end of each of the first and the second recording element, and wherein when anodization of a portion of the electroconductive protective film occurs, anodization is then also caused to occur with remaining other portions of the electroconductive protective film, thereby causing thermal characteristics of the plurality of sets of electroconductive protective films to be made uniform.

* * * * *